United States Patent [19]

Fiwek et al.

[11] Patent Number: 5,050,369

[45] Date of Patent: Sep. 24, 1991

[54] METHOD OF AND APPARATUS FOR FILLING AND CAPPING CONTAINERS FOR BEVERAGES AND THE LIKE

[75] Inventors: Wolfgang Fiwek, Wohltorf; Josef Sterba, Hamburg, both of Fed. Rep. of Germany

[73] Assignee: Alfill Getränketechnik GmbH, Hamburg, Fed. Rep. of Germany

[21] Appl. No.: 568,257

[22] Filed: Aug. 15, 1990

[30] Foreign Application Priority Data

Aug. 24, 1989 [DE] Fed. Rep. of Germany ..... 3927911

[51] Int. Cl.[5] ..... B65B 3/00; B65B 7/28; B67B 3/064

[52] U.S. Cl. ..... 53/471; 53/282; 53/306; 53/367

[58] Field of Search ..... 53/471, 485, 281, 282, 53/306, 309, 310, 313, 314, 331.5, 367

[56] References Cited

U.S. PATENT DOCUMENTS

| | | | |
|---|---|---|---|
| 3,364,652 | 1/1968 | Groth et al. | 53/282 |
| 3,683,588 | 8/1972 | Ahlers | 53/308 X |
| 3,759,012 | 9/1973 | Pagay | 53/306 |
| 3,771,284 | 11/1973 | Boeckmann et al. | 53/282 |
| 3,777,449 | 12/1973 | Sindermann | 53/306 X |
| 3,786,614 | 1/1974 | Mistarz | 53/282 X |
| 4,559,759 | 12/1985 | Herbert | 53/308 |
| 4,765,119 | 8/1988 | Aidlin et al. | 53/308 |
| 4,922,684 | 5/1990 | Nelson | 53/314 |

FOREIGN PATENT DOCUMENTS

| | | |
|---|---|---|
| 2505355 | 8/1976 | Fed. Rep. of Germany . |
| 2313268 | 6/1984 | Fed. Rep. of Germany . |

*Primary Examiner*—Horace M. Culver
*Attorney, Agent, or Firm*—Peter K. Kontler

[57] ABSTRACT

Freshly filled containers (such as cans for confinement of carbonated beverages which are admitted at an elevated pressure) are overlapped by caps or other suitable closures not later than at the point where they leave the filling unit of a combined filling and capping apparatus. The closures are maintained in alignment with and are pressed against the open tops of filled containers during advancement from the filling unit to the capping or sealing unit. This ensures that the confined liquid cannot be affected by atmospheric air and cannot escape from the respective containers irrespective of the distance of the filling unit from the capping or sealing unit.

25 Claims, 4 Drawing Sheets

METHOD OF AND APPARATUS FOR FILLING AND CAPPING CONTAINERS FOR BEVERAGES AND THE LIKE

BACKGROUND OF THE INVENTION

The invention relates to improvements in methods of and in apparatus for filling and sealing cans, bottles, jars and/or other types of containers for liquids, for example, carbonated beverages.

Conventional container filling apparatus comprise a filling assembly (e.g., in the form of a rotor) with a plurality of filling units (also called filling heads) which serve to convey liquid (e.g., a carbonated or non-carbonated beverage) from a tank into the aligned containers. Empty containers are supplied by a conveyor system in such a way that successive empty containers move to positions of alignment with successive orbiting filling units and are filled while remaining in alignment with the adjacent filling units. Successive filled containers are thereupon moved away from positions of alignment with filling units and are advanced into a capping or sealing unit to have their inlets sealed by closures in the form of caps or the like. Typical examples of liquids which can be filled in the above outlined conventional apparatus are lemonade, beer and many other carbonated or non-carbonated beverages.

A serious drawback of many heretofore known apparatus is that the distance between the filling and capping stations is very long. Thus, the open tops of filled containers remain exposed and are accessible for relatively long periods of time which results in prolonged contact between the confined liquids and oxygen in the surrounding air and/or in penetration of solid impurities into the containers which are on their way toward the capping station. Moreover, and if a conventional apparatus is designed to fill large numbers of containers per unit of time, i.e., if the filled containers are transported at a high or very high speed, a certain percentage of the body of liquid in a rapidly moving filled container which advances from the filling station to the capping station is likely to escape as a result of foaming, splashing and/or for other reasons. Still further, if a conventional apparatus is brought to a halt, e.g., due to a malfunction, the containers which happen to be located between the filling and capping stations remain exposed for long intervals of time which can affect the quality of the confined liquid as a result of foaming, contact with oxygen and/or contamination by solid substances in the surrounding atmosphere. Moreover, abrupt stoppage of containers which have left the filling station but are yet to reach the capping station can give rise to splashing and to resulting escape of liquid from the respective containers. Pronounced shortening of the path between the filling and capping stations of a conventional container filling and sealing or caping apparatus is not always possible, primarily due to the design of such apparatus and the need for the establishment of a certain distance between the filling and capping units.

OBJECTS OF THE INVENTION

An object of the invention is to provide a novel and improved method of filling and capping containers which renders it possible to avoid prolonged contact between the contents of filled containers and the surrounding atmosphere.

Another object of the invention is to provide a method which reduces the likelihood of escape of liquid from freshly filled containers while such containers are on their way toward the capping or sealing station.

A further object of the invention is to provide a novel and improved method of manipulating closures with reference to filled containers in a machine for filling and capping bottles, jars, cans or other types of containers for carbonated or uncarbonated beverages.

An additional object of the invention is to provide a method which renders it possible to assemble a container with a closure immediately following introduction of a selected quantity of liquid into the container.

Still another object of the invention is to provide a novel and improved method of reducing the space requirements and bulk of a container filling and capping apparatus without reducing its capacity.

An additional object of the invention is to provide a novel and improved apparatus for the practice of the above outlined method.

A further object of the invention is to provide the apparatus with novel and improved means for manipulating closures for filled containers prior to the establishment of positive (form-locking) sealing engagement between the containers and the respective closures.

Another object of the invention is to provide the apparatus with novel and improved means for manipulating filled containers and closures between the filling and capping stations.

A further object of the invention is to provide novel and improved means for jointly transporting filled containers and closures in an apparatus of the above outlined character.

An additional object of the invention is to provide the apparatus with novel and improved means for preventing the escape of liquid from freshly filled containers on their way toward the capping station.

Another object of the invention is to provide an apparatus whose space requirements in comparison with its output are more satisfactory than those of conventional apparatus.

A further object of the invention is to provide an apparatus which can be rapidly converted for the filling or capping of larger or smaller numbers of containers per unit of time.

SUMMARY OF THE INVENTION

One feature of the present invention resides in the provision of a method of at least partially filling successive containers of a series of containers (each of which has a liquid-admitting inlet) with a liquid (such as a pressurized carbonated beverage) and of applying closures to successive filled containers. The method comprises the steps of advancing successive containers of the series along a predetermined path, filling successive containers of the series with liquid in a first portion of the path, delivering discrete closures to positions of overlap with the inlets of successive filled containers of the series of containers in a second portion of the path downstream of the first portion, advancing successively delivered closures with the respective containers along a third portion of the path, and sealingly connecting the closures of the overlapped filled containers in the third portion of the path. The second portion of the path can but need not immediately follow the first portion, and the third portion of the path can but need not immediately follow the second portion.

The delivering step can include conveying a series of discrete closures along a second path a portion of which overlaps the second portion of the predetermined path and wherein each closure is aligned with and spaced apart form the inlet of a filled container in the second portion of the predetermined path, and effecting a movement of the filled containers and aligned closures relative to each other in order to close the inlets of the containers by the respective closures. The step of effecting a movement can include moving the closures against the inlets of the aligned filled containers.

The method preferably further comprises the step of biasin the closures against the inlets of the aligned filled containers during advancement from the second to the third portion of the predetermined path. The delivering step of such method preferably includes placing the closures above the inlets of the aligned filled containers, and the biasing step can include pressing the closures downwardly against the inlets of the aligned filled containers with a predetermined force.

At least one of the second and third portions of the predetermined path is preferably curved, at least in part. The method then further comprises the step of advancing the closures and the aligned containers along an arcuate fourth portion between the second and third portions of the predetermined path, and such arcuate fourth portion can be considered a part of the second and/or third portion of the predetermined path.

The delivering step can comprise conveying closures along an arcuate second path toward the second portion of the predetermined path.

Another feature of the invention resides in the provision of an apparatus for at least partially filling successive containers (e.g., bottles, cans or jars) having liquid-admitting inlets with a liquid (for example, with a pressurized carbonated beverage) and for applying closures (e.g., in the form of deformable caps) to successively filled or partially filled containers. The improved apparatus comprises means for advancing the containers of the series along a predetermined path, a filler assembly having means for admitting liquid into successive containers of the series in a first portion of the path (such admitting means can comprise an annulus of orbiting filling heads or units above the first portion of the path), a magazine or another suitable source of closures, means for conveying closures from the source along a second path having a portion which overlaps a second portion of the predetermined path downstream of the first portion and wherein each closure is aligned with the inlet of and advances with a liquid-containing (i.e., filled or partially filled) container along the predetermined path, and means for sealingly connecting the closures to the aligned containers in a third portion of the predetermined path downstream of the second portion. The advancing means comprises a driven first conveyor having means for jointly transporting closures and the aligned containers along and beyond the second portion of the predetermined path. The driven conveyor can constitute a rotary conveyor (e.g., a circular conveyor), and the means for jointly transporting can include sockets for liquid-containing containers. The advancing means preferably further comprises a second conveyor which defines the first portion and a third conveyor which defines the third portion of the predetermined path.

If desired, the driven conveyor can be provided with means for jointly transporting closures and containers already along a section of the first portion of the predetermined path and thereupon along the second portion of such path.

The apparatus further comprises means for aligning successive liquid-containing containers in the second portion of the predetermined path with discrete closures which are delivered by the conveying means. Such aligning means preferably comprises a first portion which directly or indirectly shares the movements of the driven conveyor and a second portion which is adjacent the driven conveyor. The second portion of the aligning means can comprise a stationary track, and the first portion of such aligning means can comprise entraining elements which serve to advance a series of discrete closures from the conveying means along the track and toward positions of alignment with the inlets of liquid-containing containers in the second portion of the predetermined path.

Alternatively, the second portion of the aligning means can include a track for a series of discrete closures and the first portion of the aligning means can comprise at least one receptacle (e.g., an arcuately slotted or recessed receptacle) which is movable with the driven conveyor and means for moving the at least one receptacle relative to the conveyor between a first position in which the receptacle accepts discrete closures from the track and a second position in which a closure which has been accepted by the receptacle is aligned with a container in the second portion of the predetermined path. If the driven conveyor is a rotary conveyor, the moving means preferably includes means for moving the at least one receptacle substantially radially of the rotary conveyor. The latter then defines for the at least one receptacle an endless path which crosses the second portion of the predetermined path. The moving means of such aligning means preferably includes means for moving the at least one receptacle radially outwardly of the driven conveyor toward the first position, thereupon radially outwardly from the first to the second position (while the at least one receptacle orbits along the endless path), and thereupon radially inwardly to thus maintain a closure in the at least one receptacle in alignment with the adjacent portion of the predetermined path.

The means for jointly transporting can include sockets which are provided in the driven conveyor for liquid-containing containers, and means for biasing closures against the inlets of aligned containers, at least during advancement of containers of the aligned closures toward the third portion of the predetermined path. The biasing means can comprise pushers which are mounted for movement with the driven conveyor and means for urging the pushers against closures with a predetermined force. The pushers can include forked levers having prongs serving to engage selected portions of closures which are aligned with containers in the second portion of the predetermined path. For example, the prongs of the forked levers can be positioned to urge the closures against those portions of aligned containers which surround the respective liquid-admitting inlets. The biasing means can further comprise a rotary carrier (e.g., a platform or disc) which supports the pushers and is spaced apart from and coaxial with the driven conveyor.

The apparatus can comprise a common support (e.g., a stationary base or bed) for the advancing means, for the filling assembly, for the conveying means and for the connecting means.

The means for jointly transporting liquid-containing containers and aligned closures can include means for pneumatically attracting containers to the driven conveyor. Such attracting means can include the aforementioned sockets in the driven conveyor to receive portions of liquid-containing containers, suction ports provided in the driven conveyor and communicating with the sockets, a suction generating device, and means for connecting the suction generating device with the suction ports. The advancing means of such apparatus can further comprise a second conveyor which serves to advance containers along the first portion of the predetermined path at a first level, and the driven conveyor can comprise means (e.g., ramps in the sockets) for shifting containers to a second level during entry of containers into the sockets of the driven conveyor. The ramps can slope upwardly from the first level toward the sockets, i.e., such ramps can serve to shift containers from the first level to a second level above the first level.

A further feature of the invention resides in the provision of an apparatus for at least partially filling successive containers of a series of containers with a liquid, particularly with a carbonated beverage. The apparatus comprises a rotary container-filling assembly having a liquid-confining tank and a plurality of filling units serving to receive liquid from the tank and to admit liquid into discrete containers, and means for rotating the assembly so that each unit completes a plurality of revolutions per minute and admits liquid into a different container during each of its revolutions. The number of filling units at most equals m/n wherein m is the maximum number of containers which receive liquid per minute (or per another selected unit of time) and n is the number of revolutions which are required to admit liquid into m containers per minute. It is preferred to ensure that m at least equals 15*n*, e.g., approximately 20*n*. The means for rotating is preferably designed to rotate the filling assembly at a speed of at least sixty revolutions per minute.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
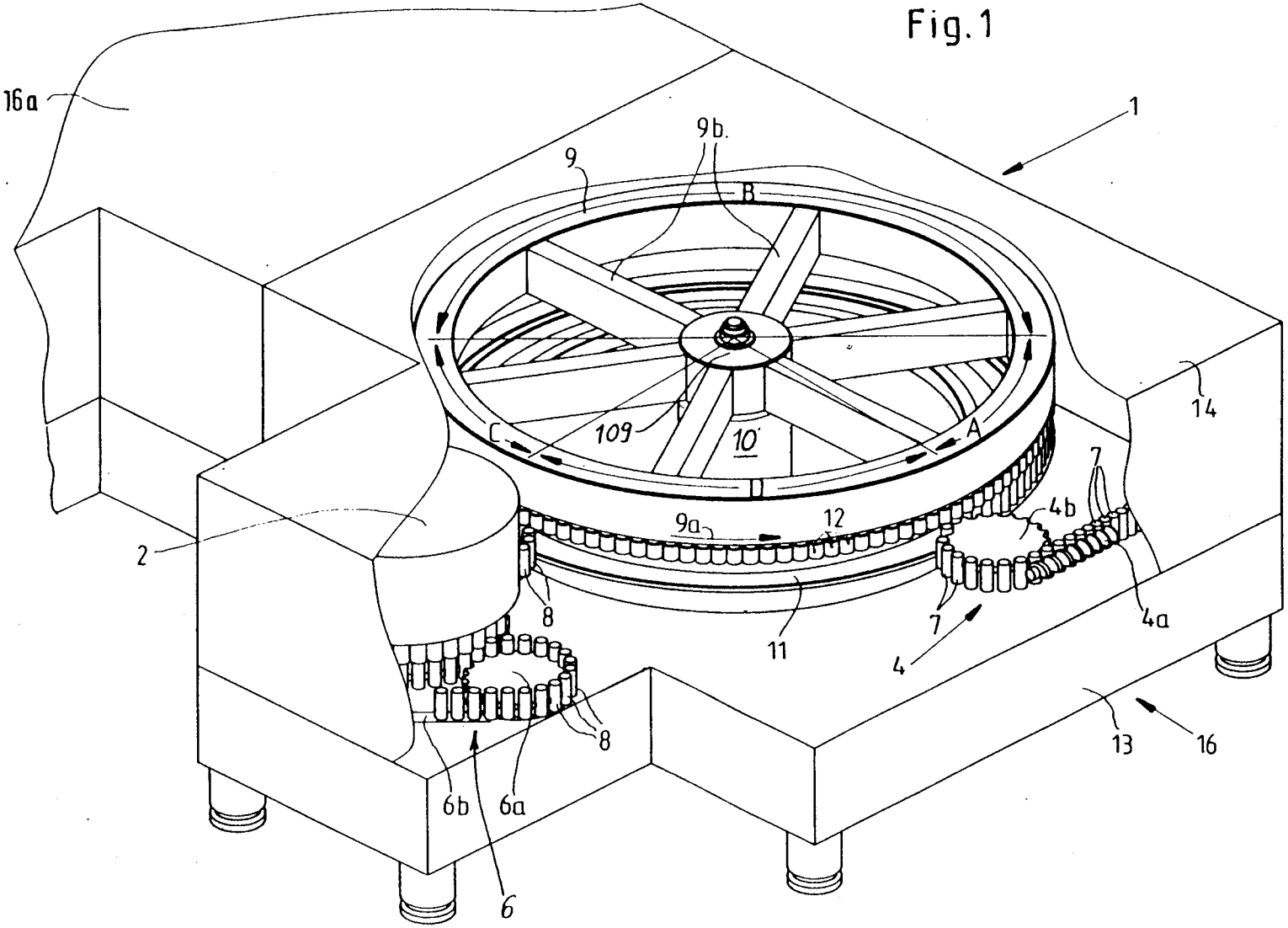
FIG. 1 is a schematic perspective view of a composite multimodular container filling and sealing apparatus which embodies one form of the invention, the hood of the front module of the composite apparatus being partially broken away and the major part of the rear module being broken away.

FIG. 1 shows two modules 16 and 16*a* each of which constitutes a complete apparatus for at least partially filling successive containers 7 (e.g., empty bottles, cans or jars) with a liquid (such as lemonade, beer or another carbonated beverage) which must be sealingly confined in the respective container as expeditiously as possible. The apparatus 16 comprises a system of conveyors which serve as a means for advancing the series of containers 7 along an elongated serpentine path. The path is defined by a feed screw 4*a* which delivers a succession of closely adjacent empty containers 7 into the range of a rotary turnstile-type transfer member 4*b*, a rotary ring-shaped conveyor 11 which advances containers along path sections A, B, C, a rotary conveyor 21 (shown in FIGS. 2 to 5 and hereinafter called driven conveyor to distinguish from other conveyors), and a rotary conveyor 102 (FIG. 2) which receives filled containers 8 from the driven conveyor 21. The feed screw 4*a* and the transfer member 4*b* together form a composite container feeding or supplying conveyor 4 which delivers empty containers 7 into the range of the rotary conveyor 11. The latter serves to advance the containers 7 in axial alignment with a complete annulus of filling heads or units 12 forming part of a container filling assembly 1. The assembly 1 further includes a rotary ring-shaped tank 9 for a supply of pressurized liquid (e.g., a beverage which contains $CO_2$ gas). The tank 9 is driven in the direction of arrow 9*a* by a motor-driven shaft 109 which is mounted in an upright column 10 on a stationary base or bed 13.

The apparatus or module 16 further comprises a magazine 17 (FIG. 2) or another suitable source of closures 18 (hereinafter called caps for short) which are to be applied over the liquid-admitting inlets 8*a* of filled containers 8 during transport of such containers and of the respective caps 18 along that (third) portion of the elongated path for the containers which is defined by the conveyors 21 and 102. The conveyor 102 can be said to form part of the container advancing means as well as of a standard capping or sealing unit 2 (FIG. 1) which is mounted on the base 13 adjacent the conveyor 21. The conveyor 21 receives a series of discrete caps 18 from the magazine 17 by way of a conveying device 22 in the form of a turnstile-type conveyor which defines a portion of an arcuate second path extending from the stack 17*a* of superimposed caps 18 in the magazine 17 to the driven conveyor 21. The latter defines a portion of the second path (for the caps 18) and, with the conveyor 11, a second portion of the path for the containers 7 and 8. The first portion of the path for the containers 7 is defined in part by the conveyor 11. The first portion of the path for containers 7 and 8 is defined by the composite conveyor 4 and the conveyor 11, the second portion of such path is defined by the conveyors 11 and 21, and the third portion of such path is defined by the conveyors 21 and 102. The second path (for the caps 18) is defined in part by the conveying device 22 and in part by the driven conveyor 21. Containers 8 which carry deformed caps 18 and the inlets 8*a* of which are already sealed by the respective deformed caps are transferred from the conveyor 102 onto a container removing conveyor 6 including a rotary transfer member 6a analogous to the transfer member 4b and a take-off conveyor 6b serving to accept finished (i.e., at least partially filled and properly sealed) containers 8 (with deformed caps 18) for delivery to storage, to a boxing or crating apparatus or to another destination.

The level of the body of liquid in the rotary tank 9 is preferably at least substantially constant. This is achieved by connecting the tank 9 with a main source or reservoir (not shown) by way of one or more conduits in the column and a plurality of radially extending conduits 9b which act not unlike spokes and couple the ring-shaped tank 9 to the shaft 109. If the body of liquid in the tank 9 is pressurized, the apparatus 16 further comprises a source of compressed gaseous fluid (e.g., $CO_2$ gas) which is admitted into a plenum chamber above the body of liquid through the column 10 and one or more conduits 9b. Reference may be had to commonly owned copending patent application Ser. No. 07/568,273 filed August 15, 1990 by Mette for "Apparatus for filling bottles and the like" which describes the details of certain presently preferred filling units 12 and the mode of setting up sources of liquid and compressed gas for admission into a rotary ring-shaped tank the bottom wall of which carries an annulus of equidistant filling units. Each filling unit 12 can include a vessel for reception of an accurately metered quantity of liquid which is thereupon permitted or compelled to flow into the container 7 on the adjacent portion of the conveyor 11.

The conveyor 11 can be a composite conveyor which comprises a discrete vertically movable platform for each filling unit 12. Reference may be had to commonly owned copending patent application Ser. No. 07/568,254 filed August 5, 1990 by Mette for "Method of and apparatus for filling containers with liquids". This application further shows sleeve-like container-centering and sealing devices which are carried by the metering vessels of the filling units.

The mode of operation of the apparatus 16 is as follows:

Successive empty containers 7 are delivered by the transfer member 4b to positions of vertical alignment with successive filling units 12 at the underside of the rotating tank 9, and the liquid-admitting inlets 8a of such containers are sealed from the atmosphere by the annular sealing elements of the respective centering sleeves which are operated in a manner as disclosed in the aforementioned commonly owned copending patent applications of Mette. The transfer of successive empty containers 7 from the member 4b onto the conveyor 11 takes place at the upstream end of the section A of the path for containers 7 and 8 from the feed screw 4a to the take-off conveyor 6b. The first step involves raising the pressure in the interior of containers 7 which advance with the conveyor 11, and this is performed by the components of the respective filling units 12 which connect the inlets of the aligned empty containers 7 with the plenum chamber above the body of liquid in the rotating tank 9.

The pressurizing step is or can be completed at the upstream end of the elongated path section B which follows the section A, and successive internally pressurized containers 7 receive (in the path section B) metered quantities of pressurized liquid from the respective filling units 12. Such metered quantities may but need not suffice to completely fill the containers 7, i.e., the capacities of the metering chambers of vessels in the filling units 12 can be selected in such a way that the (liquid-containing) containers 8 which reach the downstream end of the path section B are partially or completely filled with liquid. The pressure in the liquid-containing (hereinafter called filled) containers 8 is reduced in the path section C which follows the path section B, and the containers 8 then reach a transfer station 23 (FIG. 2) where they enter successive peripheral sockets 24 of the driven rotary conveyor 21. The section D of the endless path for the filling units 12 can be used for refilling of the chambers in the metering vessels of such units with accurately metered quantities of liquid in a manner as described in the aforementioned copending patent application Ser. No. 07/568,273. This ensures that the metering chamber of the vessel in each filling unit 12 which reaches the upstream end of the path section A already contains a metered quantity of liquid. The path sections A-C are common to the containers 7, 8 and the filling units 12, and the path section D is only for the filling units 12.

The base 13 carries all constituents of the apparatus 16, i.e., the advancing means for containers 7 and 8, the tank 9, the magazine 17, the conveying means 22, the driven conveyor 21 and the means 2 (i.e., the capping or sealing unit) which connects each filled container 8 with the adjacent properly aligned cap 18 so that the latter positively seals the inlet 8a of the respective container 8 from the atmosphere before the container reaches the transfer member 6a of the removing conveyor 6. The base 13 further carries a substantially hood-shaped housing 14 which overlies the aforeenumerated components of the apparatus 16.

It has been found that, in lieu of unduly increasing the number of filling units 12 (and hence the diameter of the tank 9), it is simpler and more economical to maintain the total number of filling units 12 in an apparatus or module 16 within certain limits and to simply set up and operate one or more additional apparatus (note the apparatus 16a of FIG. 1 which is or can be identical with or a mirror image of the apparatus 16). The total number of modules will determine the output of the composite multiple-module apparatus. It was further ascertained that the ratio of output to dimensions of the composite apparatus improves with increasing number of modules or apparatus when compared with the output and dimensions of a single apparatus employing a large tank and a total number of filling units which matches that in two or more modules of a composite apparatus.

Figure 2:
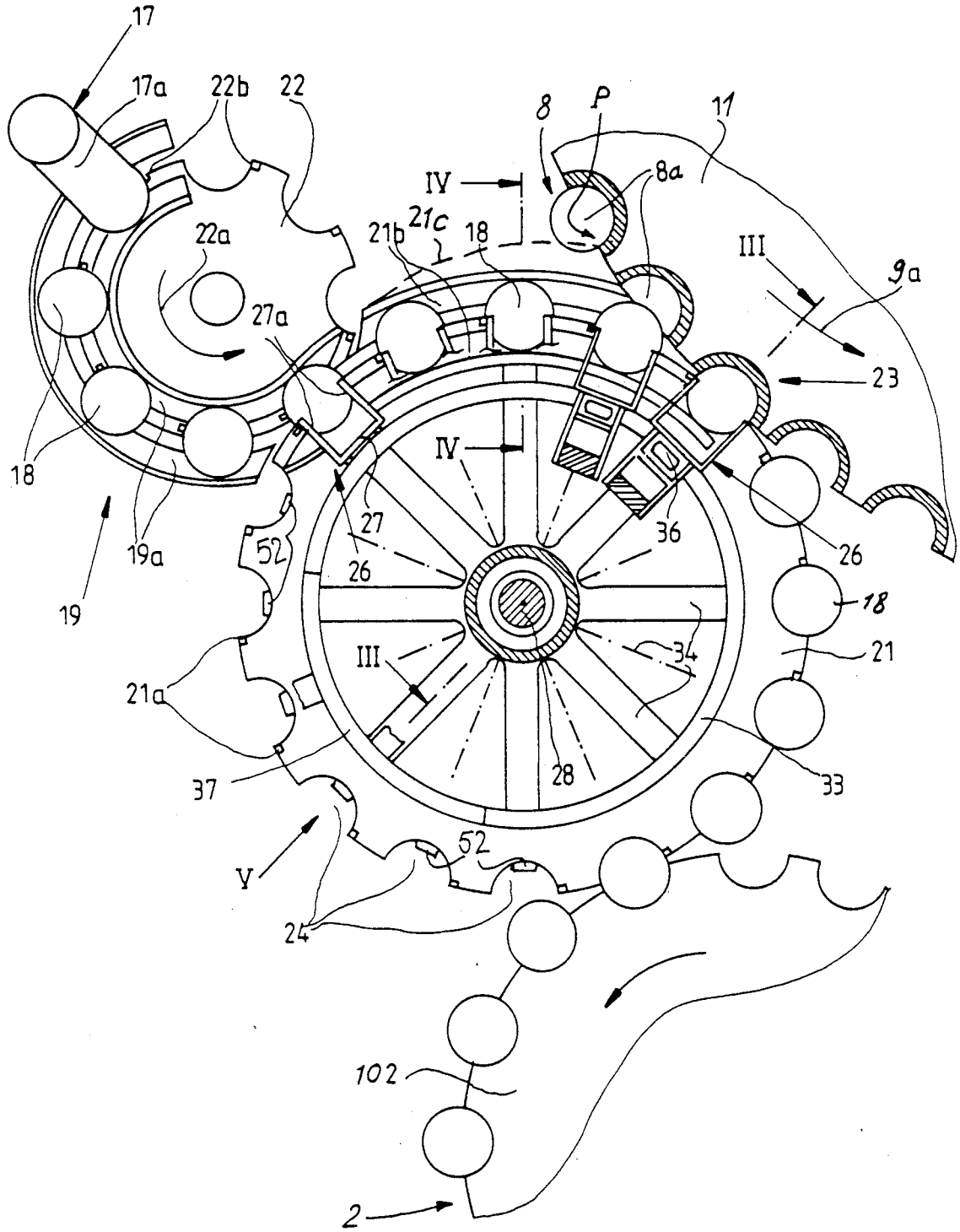
FIG. 2 is an enlarged partially plan and partially horizontal sectional view of a portion of one of the modules in the region of a transfer station where freshly filled containers leave the filling assembly, the section being taken in the direction of arrows as seen from the line II—II in FIG. 3.

FIG. 2 shows the details of the driven conveyor 21, the conveying means 22 with magazine 17 for the stack 17a of fresh caps 18, the adjacent portion of the conveyor 102, and the adjacent portion of the conveyor 11 at the transfer station 23 where the filled containers 8 and the aligned caps 18 leave the path section C to be conveyed toward the connecting means (capping unit) 2. The conveying means 22 forms part of a cap withdrawing device 19 which further includes an arcuate track 19a for successive lowermost caps 18 of the stack 17a in the magazine 17. Such lowermost caps 18 are engaged and entrained by the entraining elements 22b of the conveying means 22 which is rotated in the direction of arrow 22a. This causes successive discrete caps 18 to slide along the track 19a and onto or into a second arcuate track 21b (see also FIG. 4) which constitutes an extension or continuation of the track 19a and surrounds a portion of the conveyor 21 to terminate at or close to the transfer station 23. The exact manner in which the entraining portions 22b of the conveying means 22 singularize the stack 17a of caps 18 in the magazine 17 forms no part of the present invention.

The driven conveyor 21 is a disc (see also FIGS. 3 to 5) which is provided with the aforementioned sockets 24 for portions of filled containers 8 and further comprises entraining elements 21a disposed behind the neighboring sockets (as seen in the direction of rotation of the conveyor 21). The entraining elements 21a extend into the track 21b from below to push the oncoming caps 18 toward the transfer station 23 and toward positions of vertical alignment with the inlets 8a of filled containers 8 which are about to enter the neighboring sockets 24. The filling units 12 of the assembly 1 are lifted above and away from the inlets 8a at the tops of filled containers 8 which reach the transfer station 23 in order to permit advancement of such containers with the conveyor 21 as well as to provide room for positioning of caps 18 above the inlets 8a of such containers. That portion of the (second) path of caps 18 which is defined by the track 21b is located at a level above the inlets 8a of containers 8 which reach the transfer station 23 but beneath the lowermost portions of centering sleeves forming part of filling units 12 which reach the station 23. This ensures that each cap 18 which is advanced by an entraining element 21a can be moved to a position of exact alignment with the inlet 8a of the container 8 at the transfer station 23 (to thereupon advance with such container toward the conveyor 102) without any interference on the part of a container and/or on the part of a filling unit.

An advantage of the feature that a cap 18 is placed on top of the inlet 8a of a freshly filled container 8 (i.e., of a container which has arrived at the transfer station 23 and has been released by the respective filling unit 12 during the last stage of advancement toward the station 23) is that the inlet 8a remains exposed and accessible only for an extremely short interval of time. This greatly reduces the likelihood of splashing, bubbling or spraying of liquid out of a filled container 8 as well as the likelihood of contamination of the confined liquid, e.g., as a result of contact with oxygen in the surrounding atmosphere.

Figure 6:
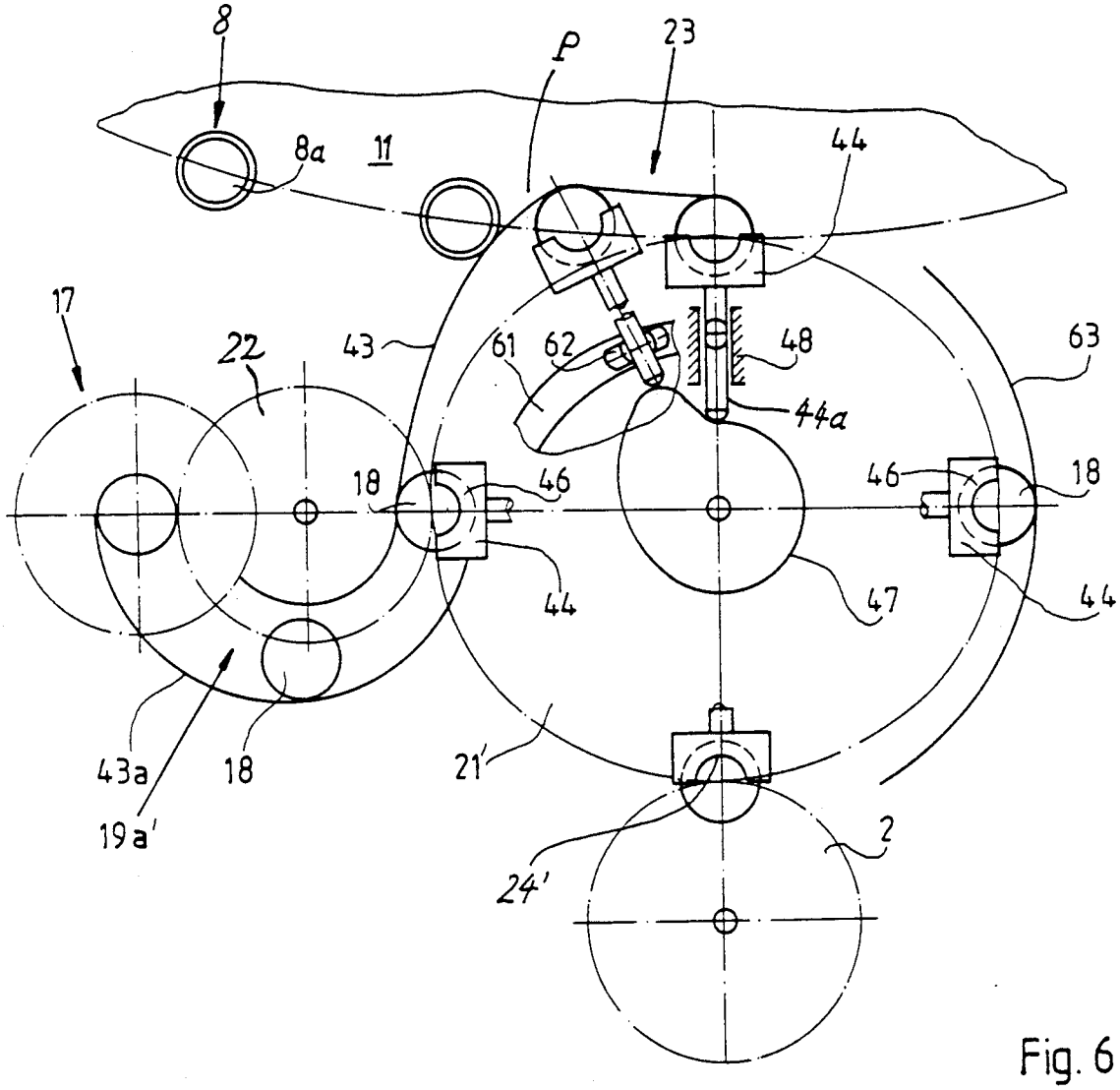
FIG. 6 is a view similar to that of FIG. 2 but showing a modified driven conveyor which can align closures with filled containers ahead of the station where successive freshly filled containers leave the filling assembly.

FIG. 2 shows that the length of the region of overlap of caps 18 with containers 8 on the conveyor 11 can be increased to exceed the distance between the centers of two neighboring filling units 12 at the underside of the rotating ring-shaped tank 9. This is shown in FIG. 2 by a broken line 21c. Thus, the configuration of the track 21b (or of an integral portion of the track 19a) is then changed so that successive foremost caps 18 are delivered into the downstream section or part of the first portion of the path for the containers 8, namely into a region at least slightly or well ahead of the locus (transfer station 23 in FIG. 2) where the containers 8 begin to leave the conveyor 11 to advance with the conveyor 21. This even further reduces the intervals of time during which the inlets 8a of filled containers 8 remain exposed. The point P where the broken line 21c of FIG. 3 reaches the path portion which is defined (for the containers 8) by the conveyor 11 can be located immediately downstream of the point where successive filling units 12 are lifted sufficiently to provide room for advancement of successive caps 18 into alignment with the inlets 8a of successive containers 8. Thus, such point P can be moved away from the transfer station 23 of FIG. 2 if the lifting of successive filling units 12 above the adjacent containers 8 takes place ahead of this station. A conveyor 21' which can be used to manipulate caps 18 for movement to positions of register ahead of the transfer station 23 of FIG. 2 is shown in FIG. 6. As will be described in detail hereinafter, the modified conveyor 21' is provided with receptacles (44) which can accept filled containers 8 from the conveyor 11 and caps 17 from an extension 43 of the track 19a', i.e., a discrete second track (21b) can be omitted.

The entraining elements 21a of the conveyor 21 which is shown in FIGS. 1-4 constitute a first portion, and the track 21b constitutes a second portion, of a device which aligns the oncoming caps 18 with successive filled containers 8. The entraining elements 21a share the movements of the conveyor 21, and the track 21b is stationary.

The sockets 24 of the conveyor 21 constitute one part of a means for jointly transporting filled containers 8 and aligned caps 18 toward the conveyor 102. The other part of such transporting means includes a device 26 which biases the caps 18 against the tops of the aligned containers 8. The biasing device 26 can be mounted (directly or indirectly) on the disc of the conveyor 21 and includes a set of forked pushers 27 in the form of one-armed levers 27 shown in FIGS. 2 to 4. FIG. 2 shows that the positions of the prongs 27a of the levers or pushers 27 are selected in such a way that they engage selected (marginal) portions of the adjacent caps 18 in order to urge such selected portions against the tops of the aligned containers 8, namely against those portions of containers which are immediately adjacent the inlets 8a. This ensures that a cap 18 which is biased by the prongs 27a of the adjacent lever 27 at least substantially seals the inlet 8a of the adjacent container 8 even before the cap is deformed (e.g., by converting it into a cup) into reliable sealing engagement with the top of the respective container 8. The prongs 27a of the levers 27 are urged against the adjacent caps 18 with a predetermined force by coil springs 32 which react against a rotary disc-shaped carrier 31 and bear against the respective levers 27. The liquid which is confined in a container 8 having its inlet 8a overlapped by a cap 18 which is biased by a lever 27 is prevented from escaping (e.g., splashing or foaming) even though the filled containers are caused to advance along arcuate portions of their path and even if the advancing means including the conveyors 11 and 21 is caused to advance the filled containers at a very high speed.

In order to enhance the reliability of the initial sealing action of caps 18 (during the intervals of advancement with aligned containers 8 toward the connecting means 2), the containers 8 which enter the sockets 24 of the conveyor 21 are preferably lifted from the level of the conveyor 11 to a somewhat higher level. This ensures that the undersides of the containers 8 which are in the process of entering the sockets 24 and advancing with the conveyor 21 do not rub against the conveyor 11. To this end, each socket 24 of the conveyor 21 contains a small ramp 52 which slopes upwardly from the upper side of the adjacent platform 53 of the conveyor 11 (see FIG. 3) so that the underside of a filled container 8 which reaches an empty socket 24 of the conveyor 21 and is pneumatically attracted against the concave surface bounding such socket is held against downward movement under the action of the respective spring-biased lever 27 bearing against the upper side of the aligned cap 18.

In addition to the sockets 24, the means for pneumatically attracting filled containers 8 to the driven conveyor 21 comprises suction channels or ports 54 which are machined into the conveyor 21 (FIG. 3) and extend to a stationary valve plate 56 abutting the underside of the conveyor 21 and having a groove registering with the discharge ends of suction ports 54. The groove is connected to the intake of a stationary suction generating device 57, e.g., a suction pump or a fan. Each socket 24 can communicate with two or more suction ports 54, depending upon the dimensions and the weight of filled containers 8. Valve plates corresponding to the valve plate 56 are used in many cigarette making and like machines to connect rotating suction ports with a stationary suction generating device.

Figure 3:
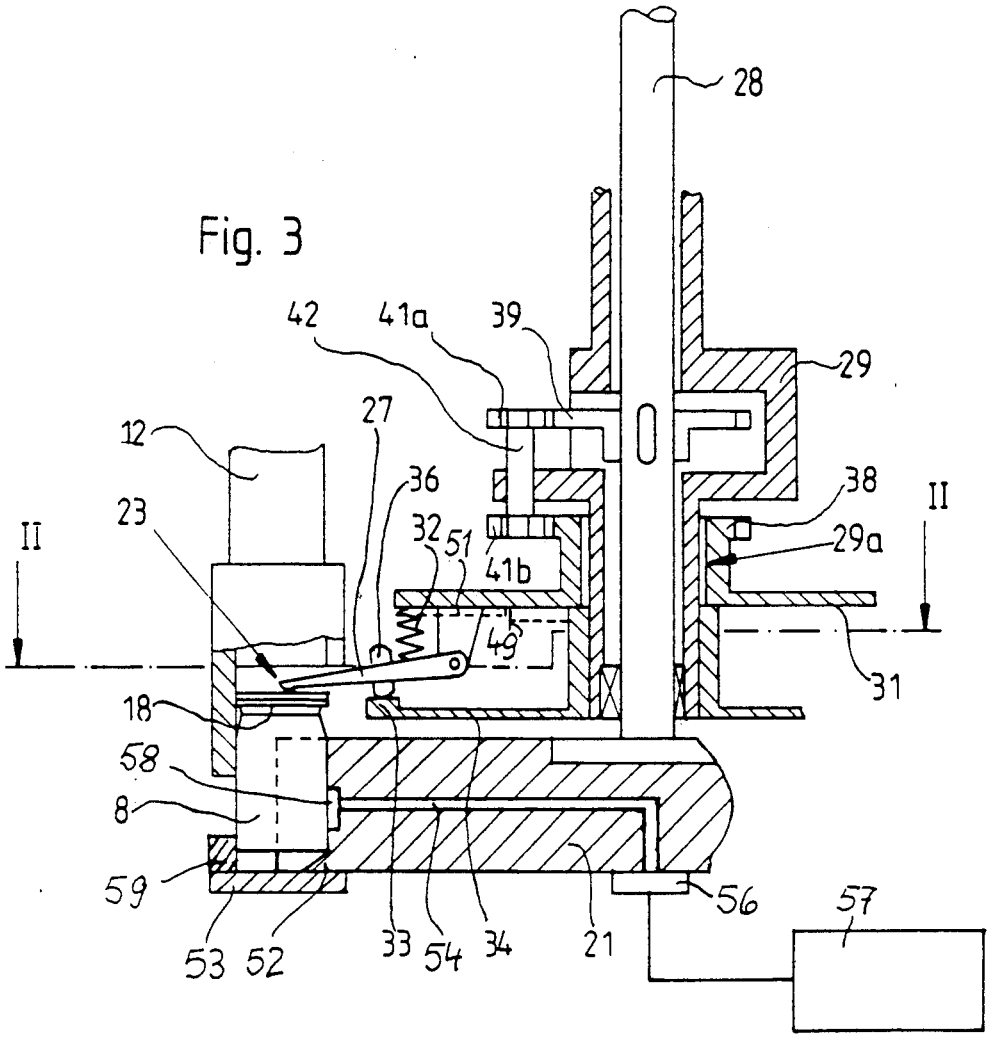
FIG. 3 is a vertical sectional view substantially as seen in the direction of arrows from the line III—II in FIG. 2.

FIG. 3 further shows a valve 58 which is provided in the conveyor 21 adjacent the illustrated socket 24 and is opened by the upright wall of a filled container 8 which has entered such socket. The valve 58 then unseals the intake end of the respective suction port or ports 54 and enables the device 57 to attract the filled container 8 to the concave surface surrounding the respective socket 24. At least one valve 58 is provided in each socket 24 to prevent unnecessary flow of air into the ports 54 which communicate with unoccupied sockets 24.

The reference character 59 denotes in FIG. 3 an abutment which is provided at the transfer station 23 to expel the oncoming filled container 8 from the conveyor 11 and to push such container against the valve 58 in the adjacent socket 24. Furthermore, the abutment 59 causes the container 8 at the transfer station 23 to slide along the ramp 52 in the respective socket 24 to be thereby lifted above and away from the platform 53 of the conveyor 11. The ramp 52 then cooperates with the suction generating device 57 to hold the filled container 8 in the socket 24 against downward movement under the bias of the respective forked lever 27 which engages and presses against the upper side of the aligned cap 18. The suction generating device 57 further ensures that a filled container 8 in the socket 24 of the conveyor 21 cannot move radially outwardly under the action of centrifugal force.

The exact locus of initial alignment of successive caps 18 with successive oncoming freshly filled containers 8 can be moved upstream of the transfer station 23 (to the point P in FIG. 2) in a manner to be described with reference to FIG. 6 as well as in a manner which is indicated in FIG. 3. Thus, each lever 27 can be mounted on a carriage or slide 51 (indicated in FIG. 3 by broken lines) which is movable radially of the conveyor 21 by a stationary cam 49. This enables the levers 27 to move radially of the conveyor 21 and to begin to exert a desired force upon a cap 18 which has reached the point P and overlies the inlet 8*a* of the adjacent (aligned) filled container 8 at least slightly ahead of the transfer station 23.

The means for rotating the conveyor 21 includes an upright shaft 28 which is rotatably journalled in a stationary casing 29 and receives torque from a prime mover, not shown. The casing 29 is provided with an external bearing 29*a* for the aforementioned disc-shaped carrier 31 of the levers 27. The means for rotating the carrier 31 in synchronism with the conveyor 21 comprises a first gear 39 which is affixed to the shaft 28, a second gear 41 which is mounted on an intermediate shaft 42 and meshes with the gear 39, a third gear 41*b* on the intermediate shaft 42, and a fourth gear 38 surrounding the bearing 29*a*, rigid with the carrier 31 and meshing with the gear 41*b*. The carrier 31 is coaxial with and is spaced apart from the conveyor 21.

The levers 27 extend radially of the carrier 31 and are pivotable about horizontal axes extending substantially tangentially of the carrier 31. Each lever 27 carries a follower 36 (e.g., a roller follower) which tracks a ring-shaped cam 33 secured to a star-shaped holder 34 of the casing 29. The springs 32 react against the carrier 31 and bias the followers 36 of the respective levers 27 against the stationary cam 33. The configuration of the cam 33 is such that the prongs 27*a* of a lever 27 which arrives at the transfer station 23 are free to move downwardly under the action of the respective spring 32 so that the prongs 27*a* can urge the adjacent cap 18 against the top of the aligned filled container 8 with a predetermined force. The illustrated coil springs 32 can be replaced with other suitable means for urging the levers 27 against the adjacent caps 18 with a preselected force.

The cam 33 lifts the prongs 27*a* of the levers 27 off the adjacent caps 18 when the caps and the aligned containers 8 enter the connecting means 2 wherein the caps are deformed into reliable sealing engagement with the tops of the aligned containers 8. The connecting means 2 can employ a suitable ram (not shown) which descends as soon as a cap 18 has advanced beyond the respective prongs 27*a*. The ram is of conventional design and serves to deform the marginal portions of successive caps 18 so that the deformed marginal portions form a ring about the customary annular beads surrounding the open tops of containers in the form of bottles or the like.

FIG. 3 shows a filling unit 12 downstream of the transfer station 23; this unit has been lifted sufficiently to permit placing of a cap 18 over the open top of the aligned container 8 and to provide room for the respective lever 27 which urges the cap against the open top of the container below it.

Figure 4:
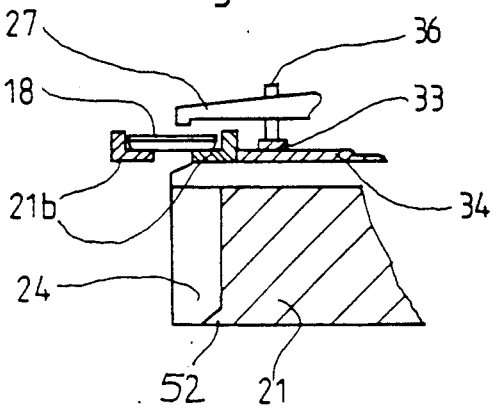
FIG. 4 is a sectional view substantially as seen in the direction of arrows from the line IV—IV of FIG. 2.

FIG. 4 shows one presently preferred form of the arcuate track 21*b* for successive discrete caps 18 which have been conveyed beyond the track 19*a* and are about to be engaged by the oncoming levers 27. The cam 33 still maintains the prongs of the lever 27 above and out of contact with the cap 18 so that the cap can be centered (by the adjacent entraining element 21*a*) relative to the respective filled container 8. The fixed track 21*b* is affixed to the holder 34, i.e., to the casing 29.

Figure 5:
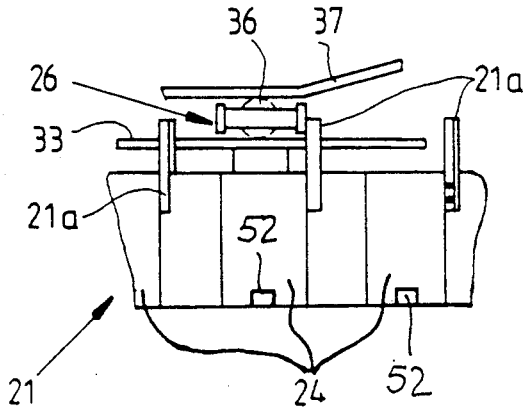
FIG. 5 shows a detail of the module substantially as seen in the direction of arrow V in FIG. 2.

FIG. 5 shows a further stationary cam 37 which is located at a level above the cam 33 and can be tracked by the followers 36 of the levers 27. The purpose of the cam 37 is to maintain the followers 36 in contact with the lower cam 33 even if the springs 32 are absent or defective. In this manner, the cam 37 ensures that a lever 27 which advances toward the transfer station 23 does not strike an adjacent filling unit 12 of the assembly 1, i.e., that the prongs 27*a* of such lever cannot rise to a level above that which is required to enter the space between an oncoming cap 18 and the lowermost points of the adjacent filling units 12. The cam 37 constitutes an optional but desirable safety feature of the improved apparatus.

An important advantage of the improved apparatus is that the number of filling units 12 in the assembly 1 need not appreciably exceed the quotient of m and n wherein m is the maximum number of containers 7 which can be filled per minute or per another unit of time, and n is the number of cycles of a filling unit 12 per minute. Thus, if each filling unit 12 is designed to fill one container 7 per revolution of the assembly 1, the number n of cycles equals the number of revolutions of the assembly 1 per minute. If the containers 7 are to receive a pressurized liquid, each cycle of a filling unit 12 includes pressurizing of an empty container (at A), admission of a metered quantity of liquid into the internally pressurized container (at B), reducing the pressure above the metered quantity of liquid in the freshly filled container 8 (at C), and admitting (at D) a metered quantity of liquid from the tank 9 into the metering vessel of the filling unit 12. All of these steps can be completed in the illustrated apparatus 16 while the assembly 1 completes one revolution.

As a rule, the number of filling units 12 should not exceed m/15, i.e., approximately 6.6 percent of the maximum number of containers 7 to be filled per minute. It has been found that a highly satisfactory ratio of the maximum number of containers to be filled per unit of time and the number of filling units 12 is m/20, especially if the containers 8 are cans or jars. Thus, if the completion of a cycle (one revolution of the aforedescribed assembly 1 per minute) takes up approximately three seconds (this can be readily achieved in an apparatus which is constructed and assembled in a manner as described here and in the aforementioned commonly owned copending patent applications and is attributable, at least to a certain extent, to the utilization of rapidly actuatable filling valves), the apparatus can fill a total of one thousand containers per minute with an assembly 1 which comprises a total of fifty filling units 12.

Were the number of filling units 12 increased for the purpose of increasing the output of the apparatus, this would necessitate a disproportionately large increase in the dimensions and space requirements of the enlarged apparatus. Thus, if the output of the apparatus were to be doubled, this would necessitate the utilization of four times more filling units, mainly because one must take into consideration the magnitude of centrifugal force acting upon the metered quantities of liquid which are confined in the filled containers. Therefore, it is advisable to select the number of filling units 12 in a manner as discussed above and to increase the output of a container filling plant by putting to use one or more additional apparatus or modules (16*a*). The utilization of modular apparatus contributes to flexibility of the plant and renders it possible to greatly reduce the output of a plant without unduly increasing its space requirements.

FIG. 6 shows the modified rotary driven conveyor 21' which need not be provided with sockets 24 of the type shown in FIG. 2. The conveyor 21' carries a set of equidistant receptacles 44 each of which is mounted for movement radially of the conveyor and has a radially extending shank 44*a* reciprocable in a suitable guide 48. The track 19*a'* is longer than the track 19*a* of FIG. 2 and serves to guide a series of discrete caps 18 all the way from the magazine 17 to the point P upstream of the transfer station 23 wherein the receptacles 8 on the conveyor 21' receive filled containers 8 from the conveyor 11 of the assembly 1. Each receptacle 44 has a socket 24' for a container 8 and an arcuate recess 46 which communicates with the socket 24' and can receive a portion of a discrete cap 18. Thus, the receptacles 44 replace the biasing means 26 of the apparatus which is shown in FIGS. 1 to 5 in that they can properly position successive caps 18 relative to the aligned containers 8.

Each recess 46 extends along an arc of approximately 180 degrees and can snugly receive approximately one-half of the marginal portion of a cap 18. The extension 43 of the guide 19*a'* is configurated in such a way that it prevents the escape of a cap 18 from the respective recess 46 during transport of such cap toward the point P where the cap becomes aligned with the oncoming freshly filled receptacle 8 ahead of the transfer station 23, namely ahead of the locus where the filled containers 8 begin to leave the conveyor 11. That portion of the track 19*a'* which is adjacent the conveying means 22 is denoted by the character 43*a*.

The means for moving the receptacles 44 radially of the conveyor 21' comprises a stationary cam 47 which is tracked by the radially innermost ends of the respective shanks 44*a*. The shanks 44*a* are also movable in the axial direction of the conveyor 21' and have followers 62 (e.g., roller followers) which track a stationary ring-shaped cam 61. The radial movability of the receptacles 44 enables them to move radially outwardly toward the track 19*a* (at the nine o'clock position of the conveyor 21' in FIG. 6) to ensure that an oncoming cap 18 enters the respective recess 46. The cam 47 thereupon causes successive receptacles 44 to continue their radially outward movement so that the caps 18 which extend into the adjacent recesses 46 travel along the extension 43 toward the point P where they become aligned with the oncoming filled containers 8, and the receptacles 44 thereupon move radially inwardly toward the axis of the rotating conveyor 21' in order to ensure that the caps 18 remain in alignment with the filled containers 8 below them. The caps 18 then move along a track 63 having a center of curvature on the axis of the conveyor 21' and serving to guide the caps toward the transfer station between the conveyor 21' and the conveyor of the connecting means 2.

FIG. 6 shows that the point P (where the caps 18 move to positions of alignment with the oncoming filled containers 8) can be placed well ahead (upstream) of the transfer station 23, i.e., well ahead of the locus where the containers 8 begin to leave the conveyor 11 in order to be advanced (by the conveyor 21') toward the conveyor of the connecting means 2. The distance of the point P from the transfer station 23 can exceed the pitch of the filling units 12, i.e., the distance between the centers of two neighboring units 12 in the assembly 1. An advantage of the apparatus which embodies the structure of FIG. 6 is that more time is available for accurate alignment of successive caps 18 with the oncoming filled containers 8 and that the inlets of freshly filled containers 8 remain exposed for even shorter intervals of time.

The sockets 24' of the receptacles 44 form part of pneumatically operated means for attracting the containers 8 by suction in a manner analogous to that shown in FIG. 3. The sockets 24' of the receptacles 44 can also contain ramps 52 (not shown in FIG. 6) to ensure that successive containers 8 are lifted to a level above that of the conveyor 11 and that the containers 8 in the sockets 24' are less likely to yield when the caps 18 are pressed against their open tops during advancement from the transfer station 23 toward the connecting means 2. Since the caps 18 are received in the respective recesses 46, the ramps lift the aligned containers 8 so that the open tops of the containers are caused to bear against the aligned caps in order to prevent the escape of liquid from filled containers on their way toward the connecting means 2.

The track 63 serves the additional purpose of preventing expulsion of containers 8 and caps 18 from the receptacles 44 under the action of centrifugal force in the event of failure of the suction generating device which attracts the containers 8 to the concave surfaces bounding the sockets 24' of the receptacles 44. This reduces the likelihood of malfunction and/or splashing of liquid out of filled containers 8 even if the conveyor 21' is rotated at a high speed. When the containers 8 are attracted to the receptacles 44 by suction, they need not contact the track 63. Instead of being held in the receptacles 44 by suction, the containers 8 can be retained therein in any other suitable way, e.g., by tongs (not shown) or magnetically.

An important advantage of the improved method and apparatus is that the open ends of filled containers 8 remain exposed for extremely short intervals of time. This is due to the fact that the caps 18 are applied over the inlets 8*a* of filled containers 8 ahead of the capping or sealing station (connecting means 2). In fact, the placing of caps 18 onto the inlets 8*a* of filled containers 8 can take place even before the containers leave the assembly 1, namely as soon as the filling units 12 are lifted (and/or the filled containers lowered) to an extent which is needed to provide room for introduction of caps 18 into the spaces above the open tops of freshly filled containers. Therefore, the distance of the transfer station 23 from the connecting means 2 is of no consequence since the inlets 8*a* of the containers 8 which advance from the station 23 toward the connecting means 2 are already sealed or practically sealed by the caps 18. The placing of caps 18 onto the inlets 8*a* of freshly filled containers 8 not later than at the transfer station 23 reduces the intervals of contact between the contents of filled containers and the atmosphere with resultant advantages regarding the quality of confined liquids. This is also desirable for purely sanitary reasons because the condition of air in the area around the conveyor 21 or 21' is not as important as in conventional apparatus wherein the inlets of filled containers remain exposed while the containers advance from the filling to the capping station.

An advantage of the biasing means 26 including the levers 27 is that the caps 18 can be urged against the adjacent containers 8 with a desired force to thus ensure that the inlets 8*a* are at least substantially sealed even before they reach the connecting means 2 and are or can be at least substantially sealed even ahead of the transfer station 23, i.e., ahead of the locus where freshly filled containers 8 leave the conveyor 11 of the filling assembly 1. The biasing means 26 including the levers 27 further ensures that the quality of liquids in the containers 8 which happen to come to a halt between the transfer station 23 and the connecting means 2 (e.g , due to a malfunction of the means for advancing the containers along their predetermined path) is not adversely affected even in the event of prolonged stoppage. Therefore, the length of the path portion for the containers 8 between the transfer station 23 and the connecting means 2 is not critical and can be shorter or longer, depending upon the availability of space under the housing 14.

The space requirements of the apparatus 16 or 16*a* can be reduced if the path portion along which the containers 8 advance from the transfer station 23 to the connecting means 2 has an arcuate shape. This is achieved by the provision of a rotary driven conveyor 21 or 21' which renders it possible to reduce the shortest distance of the transfer station 23 from the connecting means 2. The utilization of a rotary conveyor 21 or 21' in lieu of a conveyor which advances filled but yet unsealed containers along a straight path (in order to reduce the influence of centrifugal force upon the contents of filled but unsealed containers) is possible because the caps 18 overlie the respective filled containers all the way from the transfer station 23 (or even ahead of this station) to the connecting means 2.

Another advantage of the rotary conveyor 21 or 21' is that the distance of the magazine 17 for caps 18 from the transfer station 23 or from the point P can be reduced to a minimum. Thus, the track 19*a*, 21*b* or 19*a'* defines an arcuate path which remains arcuate all the way to the point P or to the transfer station 23 and permits placing of the magazine 17 into close or immediate proximity to the point P or station 23.

Still another advantage of the improved apparatus is that the conveyor 21 or 21' performs several functions including that of advancing filled containers 8 from the transfer station 23 to the connecting means 2 as well as that of transporting caps 18 along a portion of their path toward the point P or toward the transfer station 23 and also from the point P or transfer station 23 all the way into the connecting means 2. This conveyor contributes significantly to simplicity, compactness and reliability of the improved apparatus.

The apparatus which embodies the structure of FIG. 6 necessitates the utilization of more complex means (receptacles 44) for the advancement of caps 18 and filled containers 8 between the filling assembly 1 and the connecting means 2 but exhibits the advantage that the step of aligning successive discrete caps 18 with the oncoming freshly filled containers 8 can begin well ahead of the transfer station 23. This ensures that the caps 18 are properly aligned with the respective filled containers 8 not later than at the transfer station 23.

A composite apparatus which employs the module 16 plus one or more additional modules 16*a* renders it possible to readily change the capacity of a container filling plant without a proportional increase in the space requirements if the output of the plant is to be increased. This is attributable to the aforediscussed ratio of the number of filling units 12 to the maximum output of a module 16 or 16*a* per unit of time. Moreover, by maintaining one or more spare modules in a state of readiness, the operators of the container filling plant can rapidly increase the output of the plant without the need to replace the operative or running module or modules. This enhances the flexibility of the plant and shortens the intervals of time which are needed for conversion of a smaller plant into a larger plant or vice versa. Still further, a relatively small module can be more readily sealed from the surrounding atmosphere than a much larger and bulkier apparatus. Proper sealing is desirable for sanitary reasons as well as because this reduces the noise when a module is in actual use.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of at least partially filling successive cans of a series of cans having liquid-admitting inlets with a liquid and of applying closures to successive filled cans, comprising the steps of advancing successive cans of the series along a predetermined path; filling successive cans of the series in a first portion of said path; delivering discrete closures to positions of overlap and alignment with the inlets of successive filled cans of the series of cans in a second portion of said path downstream of said first portion, including placing the closures above the inlets of the aligned filled cans; advancing successively delivered closures with the respective cans along a third portion of said path; biasing the closures against the inlets of the aligned filled cans during advancement from the second to the third portion of said path, including pressing the closures downwardly against the inlets of the aligned filled cans with a predetermined force; and sealingly connecting the closures to the overlapped filled cans in the third portion of said path.

2. The method of claim 1, wherein said second portion immediately follows the first portion and said third portion immediately follows the second portion of said path.

3. The method of claim 1, wherein said delivering step includes conveying a series of discrete closures along a second path which has a portion overlapping the second portion of said predetermined path and wherein each closure is aligned with and spaced apart from the inlet of a filled can in the second portion of said predetermined path, and effecting a movement of filled cans and aligned closures relative to each other to close the inlets of such cans by the respective closures.

4. The method of claim 3, wherein said step of effecting a movement includes moving the closures against the inlets of the aligned filled cans.

5. The method of claim 1, wherein at least one of the second and third portions of the predetermined path is curved.

6. The method of claim 1, further comprising the step of advancing the closures and the aligned filled cans along an arcuate fourth portion between the second and third portions of said path.

7. The method of claim 1, wherein said delivering step comprises conveying closures along an arcuate second path toward the second portion of said predetermined path.

8. Apparatus for at least partially filling successive cans of a series of cans having liquid-admitting inlets with a liquid, particularly with a carbonated beverage, and for applying closures to successively filled cans, comprising means for advancing the cans of the series along a predetermined path; a filling assembly having means for admitting liquid into successive cans of the series in a first portion of said path; a source of closures; means for conveying closures from said source along a second path having a portion which overlaps a second portion of said predetermined path downstream of said first portion and wherein each closure is aligned with the inlet of and advances with a liquid-containing can along said predetermined path, said advancing means including a driven conveyor having means for jointly transporting closures and the aligned cans along said second portion of said predetermined path; and means for sealingly connecting the closures to the aligned cans in a third portion of said predetermined path downstream of said second portion, said means for jointly transporting including sockets for liquid-containing cans and means for biasing closures against the inlets of aligned cans, at least during advancement toward said third portion of said predetermined path.

9. The apparatus of claim 8, wherein said conveyor is a rotary conveyor and said means for jointly transporting includes sockets for liquid-containing cans, said advancing means further comprising a second conveyor defining said first portion and a third conveyor defining said third portion of said predetermined path.

10. The apparatus of claim 8, wherein said conveyor has means for jointly transporting closures and cans along a section of the first portion of said predetermined path.

11. The apparatus of claim 8, further comprising means for aligning successive liquid-containing cans in said second portion of said predetermined path with discrete closures which are delivered by said conveying means.

12. The apparatus of claim 11, wherein said aligning means includes a first portion sharing the movements of said conveyor and a second portion adjacent said conveyor.

13. The apparatus of claim 12, wherein said second portion of said aligning means comprises a stationary track and said first portion of said aligning means comprises entraining elements arranged to advance a series of discrete closures from said conveying means along said track and toward positions of alignment with the inlets of liquid-containing cans in the second portion of said predetermined path.

14. The apparatus of claim 8, further comprising a common support for said advancing means, said filling assembly, said conveying means and said connecting means.

15. Apparatus for at least partially filling successive containers of a series of containers having liquid-admitting inlets with a liquid, particularly with a carbonated beverage, and for applying closures to successively filled containers, comprising means for advancing the containers of the series along a predetermined path; a filling assembly having means for admitting liquid into successive containers of the series in a first portion of said path; a source of closures; means for conveying closures from said source along a second path having a portion which overlaps a second portion of said predetermined path downstream of said first portion and wherein each closure is aligned with the inlet of and advances with a liquid-containing container along said predetermined path, said advancing means including a driven conveyor having means for jointly transporting closures and the aligned containers along said second portion of said predetermined path; means for aligning successive liquid-containing containers in said second portion of said predetermined path with discrete closures which are delivered by said conveying means, said aligning means including a first portion sharing the movements of said conveyor and a second portion adjacent said conveyor, said second portion of said aligning means including a track for a series of discrete closures and said first portion of said aligning means comprising at least one receptacle movable with said conveyor and means for moving said at least one receptacle relative to said conveyor between a first position in which the receptacle accepts discrete closures from said track and a second position in which a closure which has been accepted by said receptacle is aligned with a container in the second portion of said predetermined path; and means for sealingly connecting the closures to the aligned containers in a third portion of said predetermined path downstream of said second position.

16. The apparatus of claim 15, wherein said conveyor is a rotary conveyor and said moving means includes means for moving said at least one receptacle substantially radially of said rotary conveyor.

17. The apparatus of claim 16, wherein said conveyor defines for said at least one receptacle an endless path which crosses the second portion of said predetermined path, said moving means including means for moving said at least one receptacle radially outwardly of said conveyor toward said first position, radially outwardly from the first to the second position and thereupon radially inwardly to maintain a closure in said at least one receptacle in alignment with the adjacent liquid-containing container in the second portion of said predetermined path.

18. Apparatus for at least partially filling successive containers of a series of containers having liquid-admitting inlets with a liquid, particularly with a carbonated beverage, and for applying closures to successively filled containers, comprising means for advancing the containers of the series along a predetermined path; a filling assembly having means for admitting liquid into successive containers of the series in a first portion of said path; a source of closures; means for conveying closures from said source along a second path having a portion which overlaps a second portion of said predetermined path downstream of said first portion and wherein each closure is aligned with the inlet of and advances with a liquid-containing container along said predetermined path, said advancing means including a driven conveyor having means for jointly transporting closures and the aligned containers along said second portion of said predetermined path; and means for sealingly connecting the closures to the aligned containers in a third portion of said predetermined path downstream of said second portion, said means for jointly transporting including sockets for liquid-containing containers and means for biasing closures against the inlets of aligned containers, at least during advancement toward said third portion of said predetermined path, said biasing means comprising pushers mounted for movement with said conveyor and means for urging said pushers against closures with a predetermined force.

19. The apparatus of claim 8, wherein said pushers include forked levers having prongs engaging selected portions of closures which are aligned with containers in the second portion of said predetermined path.

20. The apparatus of claim 8, wherein said conveyor is a rotary conveyor and said biasing means further includes a rotary carrier for said pushers, said carrier being spaced apart from and being coaxial with said conveyor.

21. Apparatus for at least partially filling successive cans of a series of cans having liquid-admitting inlets with a liquid, particularly with a carbonated beverage, and for applying closures to successively filled cans, comprising means for advancing the cans of the series along a predetermined path; a filling assembly having means for admitting liquid into successive cans of the series in a first portion of said path; a source of closures; means for conveying closures from said source along a second path having a portion which overlaps a second portion of said predetermined path downstream of said first portion and wherein each closure is aligned with the inlet of and advances with a liquid-containing can along said predetermined path, said advancing means comprising a driven conveyor having means for jointly transporting closures and the aligned cans along said second portion of said predetermined path, said means for jointly transporting including means for pneumatically attracting cans to said conveyor; and means for sealingly connecting the closures to the aligned cans in a third portion of said predetermined path downstream of said second portion.

22. The apparatus of claim 21, wherein said attracting means includes sockets in said driven conveyor for portions of liquid-containing cans, suction ports provided in said conveyor and communicating with said sockets, a suction generating device, and means for connecting said suction generating device with said ports.

23. The apparatus of claim 22, wherein said advancing means further comprises a second conveyor arranged to advance containers along said first portion of said predetermined path at a first level and said driven conveyor comprises means for shifting containers to a second level during entry of the containers into the sockets of said driven conveyor.

24. The apparatus of claim 23, wherein said second level is above said first level.

25. Apparatus for at least partially filling successive cans of a series of cans having liquid-admitting inlets with a liquid, particularly with a carbonated beverage, and for applying closures to successively filled cans, comprising means for advancing the cans of the series along a predetermined path; a filling assembly having means for admitting liquid into successive cans of the series in a first portion of said path; a source of closures; means for conveying closures from said source along a second path having a portion which overlaps a second portion of said predetermined path downstream of said first portion and wherein each closure is aligned with the inlet of and advances with a liquid-containing can along said predetermined path, said advancing means comprising a driven conveyor having means for jointly transporting closures and the aligned cans along said second portion of said predetermined path, said means for jointly transporting including means for pneumatically attracting cans to said conveyor and said attracting means including sockets in said driven conveyor for portions of liquid-containing cans, suction ports provided in said conveyor and communicating with said sockets, a suction generating device, and means for connecting said suction generating device with said ports, said advancing means further comprising a second conveyor arranged to advance cans along said first portion of said predetermined path at a first level and said driven conveyor comprising means for shifting cans to a second level during entry of the cans into the sockets of said driven conveyor, said shifting means including ramps which slope upwardly from said first level in the sockets of said driven conveyor to urge the inlets of the cans in said sockets against the aligned closures while the cans are being held by suction.

* * * * *